United States Patent [19]

Schonwald

[11] 4,006,998

[45] Feb. 8, 1977

[54] RING COMPRESSOR

[75] Inventor: Siegfried Schonwald, Bad Neustadt, Saale, Germany

[73] Assignee: Siemens Aktiengesellschaft, Munich, Germany

[22] Filed: July 7, 1975

[21] Appl. No.: 593,384

[30] Foreign Application Priority Data

July 23, 1974 Germany ..... 2435432

[52] U.S. Cl. ..... 415/213 T

[51] Int. Cl.[2] ..... F04D 7/00

[58] Field of Search ..... 415/213 T, 199 T, 198 T, 415/53 T

[56] References Cited

UNITED STATES PATENTS 1,893,616 1/1933 Ferguson ..... 415/213 T

FOREIGN PATENTS OR APPLICATIONS 855,363 11/1952 Germany ..... 415/213 T

*Primary Examiner*—Henry F. Raduazo

*Attorney, Agent, or Firm*—Kenyon & Kenyon Reilly Carr & Chapin

[57] ABSTRACT

An impeller for a ring compressor is disclosed. More particularly, the impeller is designed so that the ratio of the area of the individual blades of the impeller to the cross section area of the side channel of the compressor is equal to or smaller than 0.72 and so that the ratio of the pitch or spacing between adjacent blades of the impeller to the width dimension of the side channel cross section is likewise equal to or smaller than 0.72. Design of the impeller in this manner decreases the gas volume dragged across the interrupter or break in the side channel without appreciably decreasing the discharge head.

1 Claim, 3 Drawing Figures

RING COMPRESSOR

BACKGROUND OF THE INVENTION

1. Field of the Invention

The invention concerns impellers and, in particular, impellers for use in ring compressors.

2. Description of the Prior Art

When using a ring compressor employing an impeller to compress gases to pressure ratios of more than 1.2, the compressibility of the gas is found to have a detrimental effect on the compressor operation. In particular, the gas compressed into the blade cells (i.e., the regions between the impeller blades) is dragged across the break situated between the entrance and the exit openings of the side channel of the compressor. It then expands on the suction side of the compressor into the side channel, thereby causing a decrease in the useful draw in flow. Such a decrease in the draw in flow, in turn, limits the attainable pressure ratio and the attainable efficiency of the compressor.

It is therefore an object of the present invention to provide an impeller for a ring compressor which results in improved performance of the compressor.

SUMMARY OF THE INVENTION

In accordance with the principles of the present invention, the above and other objectives have been achieved as a result of the realization that the generation of pressure in the compressor is governed by the total area of the blades of the impeller, i.e., by the product of the individual blade area and the number of blades, while the volume or degree of gas dragged across the opening of the side channel is governed by the product of the individual blade area and the circumference of the impeller. This, in turn, means that by appropriately decreasing the individual blade area and appropriately increasing the total number of blades, a decrease in the volume of dragged across gas can be realized without any appreciable decrease in gas pressure.

In accordance with the invention, the aforesaid is realized by designing the impeller of the compressor such that the ratio of the individual blade area to the cross section area of the side channel of the compressor is equal to or smaller than 0.72 and such that the ratio of the blade spacing or pitch to the width dimension of the side channel area is likewise equal to or smaller than 0.72.

BRIEF DESCRIPTION OF THE DRAWING

The above and other objects and features of the present invention will become more apparent upon reading the following detailed description viewed in conjunction with the accompanying drawing, in which.

DETAILED DESCRIPTION

Figure 3:
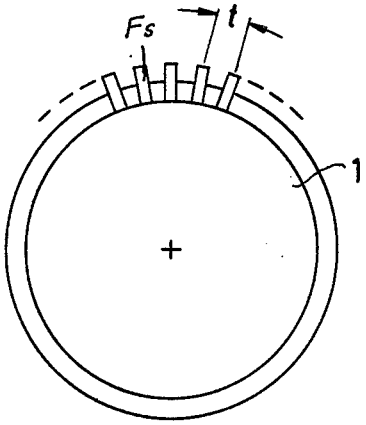
FIG. 3 shows, also in schematic view, an impeller in accordance with the invention.

FIG. 3 shows an impeller 1 of a compressor (not shown) in accordance with the principles of the present invention. As illustrated, the impeller 1 has a pitch or spacing $t$ between individual blades. In accord with the invention, the impeller 1 is designed such that the ratio of the individual blade area $F_s$ of the impeller blades (the lateral area of each blade facing the side channel of the compressor and normal to the axis of rotation of the impeller) to the cross section area of the side channel of the compressor is equal to or less than 0.72. Advantageously, designing the impeller in such a manner results in a decrease in individual blade area and, hence, a decrease in the volume of the gas dragged across the side channel opening of the compressor over that which would occur if the impeller were conventionally designed (i.e., if it had a larger individual blade area and, therefore, a larger ratio lying in the range 0.75 to 1.1).

Additionally, in further accord with the invention, in order to prevent the use of the above-mentioned ratio in the present impeller from resulting in a decrease in compressor pressure over that acheivable using a conventionally designed impeller, the impeller is further designed so that the ratio of the blade pitch $t$ to the width dimension of the side channel cross section area is equal to or less than 0.72.

With the impeller designed in the latter manner, the total number of impeller blades is increased, thereby compensating for the decrease in total blade area brought about by the decrease in individual blade area.

In one particular design of the present impeller particularly advantageous results have been realized using a ratio of individual blade area to side channel cross section area equal to 0.51 and a ratio of pitch to side channel width of 0.64.

Figure 1:
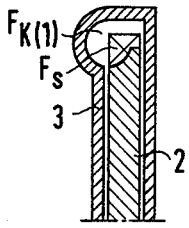
FIG. 1 shows, in schematic view, a single-flow ring compressor employing an impeller in accordance with the invention.

FIG. 1 shows an impeller 2 similar to impeller 1 disposed within the housing 3 of a single channel compressor. In this figure $F_s$ represents the individual blade area and $F_{k(1)}$ the channel cross section area. For this type of compressor the width $b$ of the side channel is given as $b = \sqrt{2F_{k(1)}/\pi}$.

As above-indicated, in accord with the invention the impeller 2 is designed such that $F_s/F_{k(1)} \leq 0.72$ and $t/b \leq 0.72$, $t$ being the impeller blade spacing.

Figure 2:
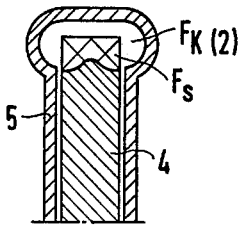
FIG. 2 illustrates, in schematic view, a double-flow ring compressor employing an impeller in accordance with the invention.

In FIG. 2, an impeller 4 similar to that in FIG. 1 is disposed within the housing of a double channel compressor. In this figure $F_s$ again represents the individual blade area, while $F_{k(2)}$ represents the channel cross section area. In this case the width $b$ of the side channel is given as $b = \sqrt{F_{k(2)}/\pi}$.

As in FIG. 1, the impeller 4 in FIG. 2 is designed so that $F_s/F_{k(2)} \leq 0.72$ and $t/b \leq 0.72$, $t$ again being the impeller blade spacing.

What is claimed is:

1. A ring compressor having a housing with a side channel impeller for use with said ring compressor, said impeller comprising:

a number of blades, said blades each having a lateral end area whose ratio relative to the axial cross section area of said side channel is equal to or less than 0.72 and each said blade being spaced relative to the next adjacent blade by an amount whose ratio relative to the width dimension of said cross section area is equal to or less than 0.72.

* * * * *